US005365985A

United States Patent [19]

Todd et al.

[11] Patent Number: 5,365,985

[45] Date of Patent: Nov. 22, 1994

[54] VAPOR GUARD FOR VAPOR RECOVERY SYSTEM

[75] Inventors: John A. Todd, Salisbury, Md.; William H. Constantine, Chesapeake, Va.

[73] Assignee: Dresser Industries, Inc., Dallas, Tex.

[21] Appl. No.: 154,770

[22] Filed: Nov. 18, 1993

[51] Int. Cl.[5] ..... B65B 3/00

[52] U.S. Cl. ..... 141/392; 141/97; 141/286; 141/391

[58] Field of Search ..... 141/97, 391, 392, 206–227, 141/59, 44–46, 286

[56] References Cited

U.S. PATENT DOCUMENTS

| | | | |
|---|---|---|---|
| 2,723,070 | 11/1955 | Merriam | 141/97 X |
| 3,016,928 | 1/1962 | Brandt | 141/45 |
| 3,566,928 | 3/1971 | Hansel | 141/97 |
| 3,581,782 | 6/1971 | Onufer | 141/59 |
| 3,710,830 | 1/1973 | Gilson | 141/392 X |
| 3,710,831 | 1/1973 | Riegel | 141/207 |
| 3,815,327 | 6/1974 | Viland . | |
| 3,899,009 | 8/1975 | Taylor | 141/59 |
| 3,907,010 | 9/1975 | Burtis et al. | 141/45 |
| 3,946,771 | 3/1976 | Braun et al. | 141/59 |
| 3,946,773 | 3/1976 | Hansel . | |
| 3,974,865 | 8/1976 | Fenton et al. | 141/392 X |
| 3,996,979 | 12/1976 | Barr et al. | 141/392 X |
| 4,010,781 | 3/1977 | Sutcliffe | 141/392 |
| 4,023,601 | 5/1977 | Hansel | 141/207 |
| 4,031,930 | 6/1977 | Sutcliffe et al. | 141/207 |
| 4,056,131 | 11/1977 | Healy | 141/206 |
| 4,057,086 | 11/1977 | Healy | 141/206 |
| 4,059,135 | 11/1977 | Hansel | 141/207 |
| 4,071,059 | 1/1978 | Hansel | 141/392 X |
| 4,108,223 | 8/1978 | Hansel | 141/392 |
| 4,131,140 | 12/1978 | Deters | 141/206 |
| 4,143,689 | 3/1979 | Conley et al. | 141/207 |
| 4,197,883 | 4/1980 | Mayer | 141/59 |
| 4,276,916 | 7/1981 | Ostand | 141/206 |
| 4,418,730 | 12/1983 | McMath | 141/207 |
| 5,040,577 | 8/1991 | Pope | 141/59 |

FOREIGN PATENT DOCUMENTS

| | | |
|---|---|---|
| 3613453 | 10/1987 | Germany . |
| 8717378 | 10/1988 | Germany . |

*Primary Examiner*—Ernest G. Cusick

[57] ABSTRACT

A vapor guard mounted on a gasoline dispenser nozzle includes a collapsible resilient section which provides a limited expansion force enabling the use of a standard gasoline dispenser retainer spring to catch on the vehicle fill pipe flange for hands-free fuel dispensing and straight-pull removal. The expansion force of the collapsible resilient section also is limited to ensure the existence of non-sealing contact between the end of the vapor guard and the fill pipe flange. The vapor guard is sized and positioned on the dispenser to enable the user to see the end of the nozzle as it is inserted into the vehicle fill pipe and aligned with a nozzle port in a restricter plate located in the fill pipe.

12 Claims, 2 Drawing Sheets

VAPOR GUARD FOR VAPOR RECOVERY SYSTEM

TECHNICAL FIELD

The present invention relates generally to vapor recovery systems and, in particular, to a vapor guard such as is mounted around a gasoline dispenser nozzle to engage the end of a gasoline tank fill pipe to keep excessive amounts of gasoline vapors from escaping into the atmosphere as the tank is being filled.

BACKGROUND INFORMATION

Federal environmental pollution standards and some state standards limit the amount of gasoline vapors that may be allowed to escape into the atmosphere during filling of a gasoline tank for a vehicle. In an empty gas tank which is being filled with gasoline, the vapors that are in the tank are driven out as liquid gasoline is pumped into the tank. California standards require as a minimum that at least ninety five percent (95%) of the vapors exhausted from a gasoline tank as it is being filled are recovered and kept from escaping into the atmosphere.

In one system currently under use in California, a collapsible bellows surrounds all but a small portion of the outlet end of a dispenser nozzle and in use seals against the exterior flange of a fill pipe. The bellows thus creates a sealed cavity between the outside of the nozzle and the end of the fill pipe to form a closed system. As gasoline is pumped into the tank from the nozzle, the vapors driven out of the tank are sucked into a vapor recovery line extending through the dispenser and leading to a remote storage vessel. The vapors enter the recovery line through inlet ports spaced from the end of the discharge opening of the nozzle. With this type of system, the collection of vapors is done on a one-to-one volumetric relationship with one volume of vapor being recovered for each volume of gasoline dispensed into the tank.

Use of the foregoing described nozzle bellows arrangement is difficult for some. In modern gasoline powered vehicles, a restricter plate is mounted in the fill pipe and includes a small port through which the end of the nozzle must fit before gasoline can be dispensed. The bellows conceals the end of the nozzle once in the fill pipe making it hard to align the nozzle with the small port. Moreover, before fuel may be dispensed from the nozzle, a seal must have been made with the end of the bellows against the flange of the fill pipe. The bellows is spring loaded so that some force is required in order to effect the seal. This force also must be maintained while the fuel is being dispensed into the tank. Thus, for those dispensers requiring hands on operation, a customer must continuously push inwardly against the dispenser to maintain the seal while also depressing the trigger of the dispenser. For those fuel dispensers which include an automatic trigger lock, a retainer mechanism on the nozzle is designed to latch with the inside edge of the fill pipe flange and may be utilized to hold the bellows in place against the end of the fill pipe. Manipulation of this locking feature and the push-pull nature of its release can be difficult. One example of the foregoing general type of dispenser is shown in U.S. Pat. No. 4,276,916. Another patent disclosing the use of a bellows to seal between the body of a dispenser nozzle and the end of a fill pipe is disclosed in U.S. Pat. No. 4,306,594.

In another form of vapor recovery system which does not utilize a bellows seal, both air and gasoline vapors are collected from the fill pipe in a volumetric amount in excess of the volume of liquid gasoline which is pumped into the vehicle gasoline tank. With such an arrangement, it is important to the storage of fuel vapors that the amount of air being included with the fuel vapors be kept to a minimum to avoid building pressure in the underground storage tank. In some vehicles, the construction of gasoline tanks is such that a vent pipe from within the tank is opened in the fill pipe upstream of the restricter port permitting the flow of air to mix with gasoline vapors and a possible reduction of the recovered volume of gasoline vapors.

The prior art also includes a splash guard which is mounted on the dispenser nozzle and merely serves to protect a customer against gasoline splashing. One form of prior art splash guard includes an elastomeric disc curved in a shape so as to deflect gasoline back toward the fill pipe. This disc shaped form of splash guard, however, is not intended to nor does it function to limit the escape of gasoline vapors into the atmosphere.

SUMMARY OF INVENTION

The present invention aims to provide a new and improved nozzle guard or barrier for a gas dispenser making it easier to use than the prior art nozzle bellows arrangements while continuing to meet the environmental pollution requirements for gasoline vapor recovery and also keeping excessive air from being drawn into the recovery line. Herein, this is accomplished with the novel construction of an elastomeric mixture barrier having first and second end sections, and a collapsibly resilient intermediate section. Uniquely, the intermediate section is constructed to provide a limited expansion force so as to enable the use of the usual spring retainer to catch on the fill pipe flange for hands-free dispensing and straight-pull removal but without requiring a seal to be made between the barrier and the end of the fill pipe.

More specifically, the invention resides in the provision of a novel barrier that is uniquely sized and positioned on the dispenser nozzle so as to allow the customer to see the end of the nozzle as it is inserted into the end of the fill pipe and aligned with the nozzle port in the restricter plate. Moreover, advantage is taken of the finish irregularities of the end of the barrier which engages the fill pipe in combination with the limited expansion force of the intermediate section to insure that non-sealing contact occurs between the barrier and the fill pipe flange regardless of the differences in pressures that might normally exist between the inside of the barrier and the outside.

The foregoing and other advantages of the present invention will become more apparent from the following description of the best mode for carrying out the invention when taken in conjunction with the accompanying drawings.

BEST MODE FOR CARRYING OUT THE INVENTION

Figures 1, 4:
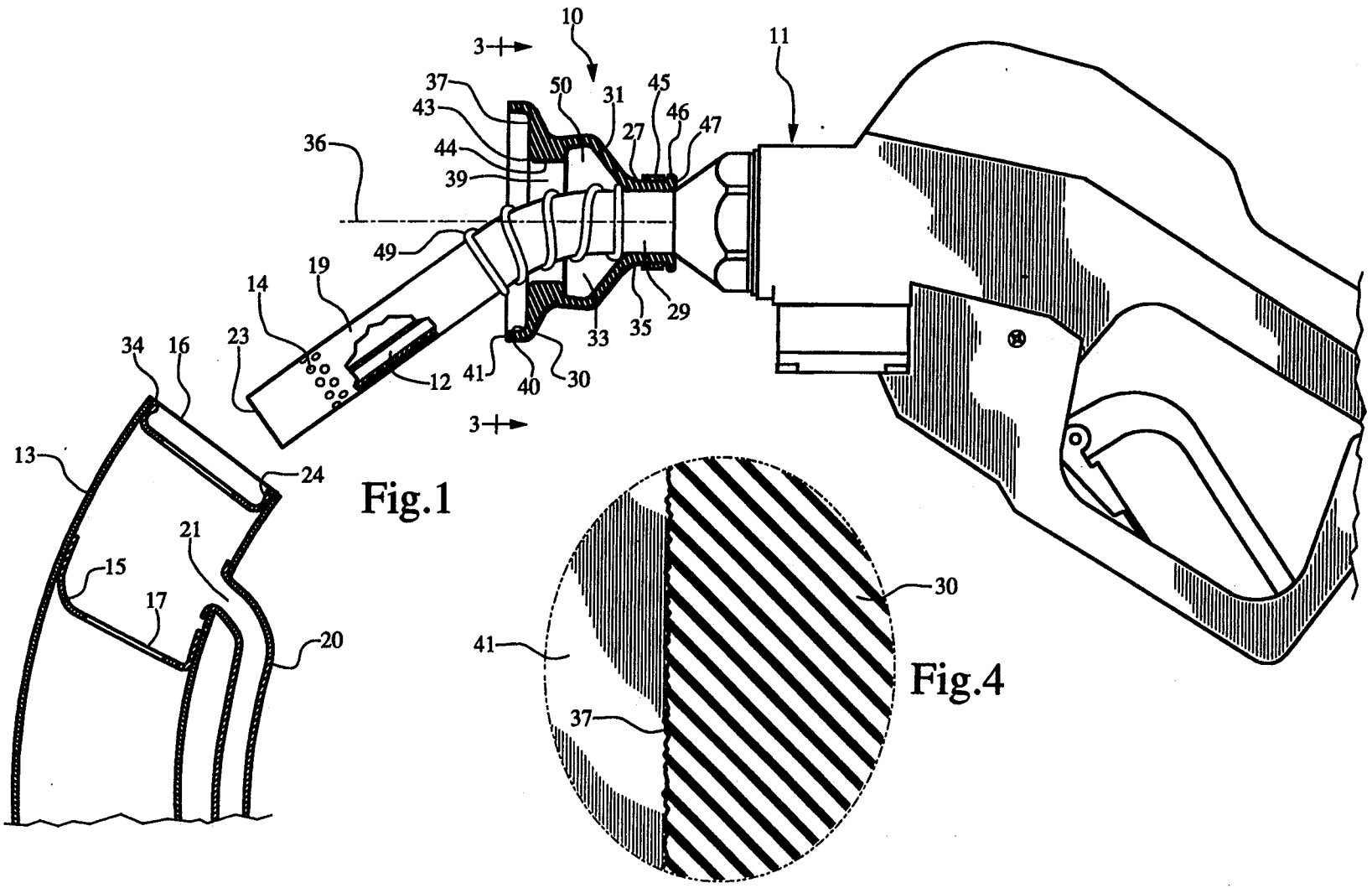
FIG. 1 is an elevational view of a gasoline dispenser showing mounted thereon in cross-section a mixture barrier incorporating the novel features of the present invention.
FIG. 4 is an enlarged view showing natural finish irregularities on a portion of the gasoline dispenser of FIG. 1.

As shown in the drawings for purposes of illustration, the present invention is embodied in a flexible barrier 10 particularly adapted for use on a gasoline dispenser 11 when filling the gas tank of a vehicle to protect against the loss of fuel vapors into the atmosphere in excess of a mandated amount. In vapor recovery systems, the gasoline vapors expelled from a vehicle tank by incoming liquid gasoline are recovered from the end of the fill pipe 13 of the tank and delivered to a remote storage tank (not shown). The general structure of such vapor recovery systems is well known and thus is not shown nor described in detail. Typically however, such systems include a control mechanism which correlates the operation of a volumetric vapor recovery device (not shown) in relation to the volume of liquid gasoline being dispensed. A vapor recovery passage 12 connects through the dispenser and has an inlet 14 positioned to recover vapors as they are driven from the tank. The outlet of the line is to the remote storage vessel usually located underground.

As shown in FIG. 1, the fill pipe 13 of a modern gasoline powered vehicle includes a restricter plate 15 disposed inwardly of the opening 16 of the pipe. A nozzle port 17 in the plate is sized to receive the nozzle 19 of the dispenser 11 to limit the type of fuel that may be dispensed into the tank. As fuel is delivered, vapor is driven from the tank flowing outwardly both through the fill pipe and a vent line 20. Within the tank, the latter is connected above the fill pipe outlet and includes a discharge opening 21 into the fill pipe adjacent the restricter plate 15. The exact location of the vent line discharge opening varies from vehicle to vehicle. Herein, the opening is shown located above the restricter plate 15 and the inlet for the vapor recovery line is located in the nozzle 19 upstream of the fuel outlet 23.

Figures 2, 3:
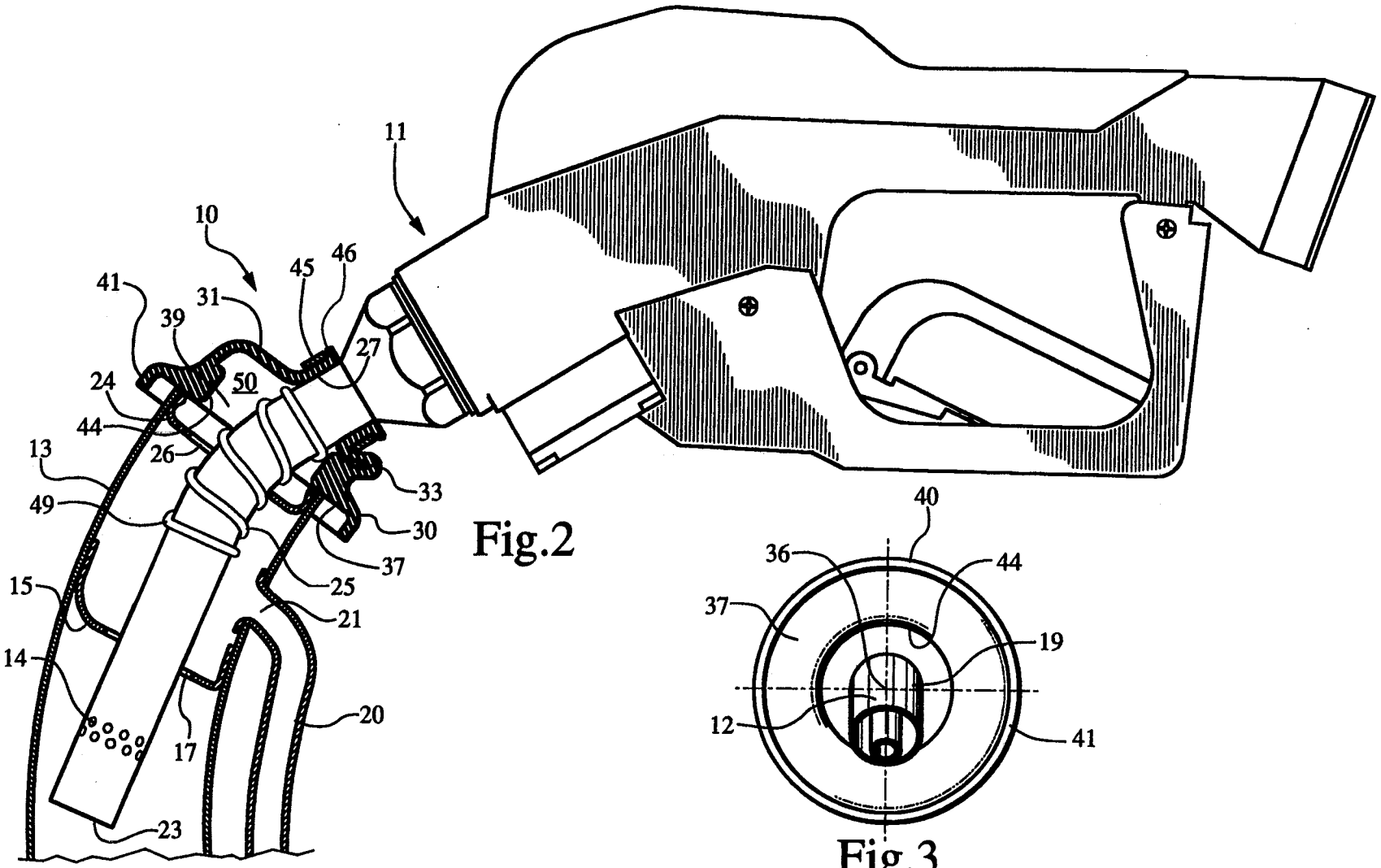
FIG. 2 is a view similar to FIG. 1 but showing the dispenser nozzle inserted into a fill pipe of a gas tank in a dispensing position.
FIG. 3 is a view taken along line 3—3 of FIG. 1.

It is important for modern self-service gas stations to make it as easy as possible for customers to fill their tanks. Thus, the ability to easily insert and remove the dispenser nozzle 19 from the fill pipe is important. It also is important that the dispenser be equipped for hands-free operation. A hands-free dispensing position is shown in FIG. 2, with the nozzle of the dispenser 11 resting eccentrically of the fill pipe opening 16 on a flange 24 which encircles the opening. In this position, a retainer mechanism, herein in the form of a spring 25, secured around the nozzle catches on the inner lip 26 of the flange to hold the dispenser against falling out of the fill pipe.

In some prior arrangements exemplified by the bellows seal configuration disclosed in U.S. Pat. No. 3,974,865, a retainer ring provides a shoulder to catch and sealingly hold an annular seal face of the bellows against the end of the fill pipe. Use of the bellows seal arrangement, while effective for meeting mandated vapor recovery standards, is difficult for customer usage. The bellows can block the view of a customer when aligning the end of the nozzle with the restricter port. Moreover, because the retainer must hold the bellows in sealing engagement with the flange, more manipulation of the dispenser is required than simply a straight-pull to remove the nozzle from the fill pipe.

In accordance with the primary aim of the present invention, the barrier 10 is uniquely constructed of a resiliently collapsible elastomeric material in a novel tubular configuration sized and shaped to fit around the dispenser nozzle so as to enable an operator to easily see to align the nozzle with the port in the restricter plate when inserting the nozzle into the fill pipe and to allow for hands-free dispensing and straight-pull removal without the requirement of effecting a seal with the fill pipe flange in order to meet vapor recovery standards. For these purposes, the barrier includes an inner or first end section 27 sealed around the base 29 of the nozzle 19 and an outer or second end section 30 surrounding the nozzle 19 upstream of the outlet 23. An intermediate section 31 extends between the inner and outer end sections forming a chamber 33 around the nozzle and is collapsed when the outer end section engages the fill pipe flange 24 when fuel is being dispensed. Advantageously, the thickness of the intermediate section when variably collapsed along the length of the nozzle is such as to provide an expansion force limited to maintain contact between the outer end section and the flange but without effecting a seal. By virtue of this, the usual retainer spring may be used for hands-free fuel dispensing and straight-pull removal thus avoiding, for example, the insertion and removal manipulations required of prior nozzle bellows arrangement.

In the present instance, the elastomeric material of the barrier 10 is comprised of polyurethane having a Shore A durometer hardness of 80 to 90. When relaxed, the barrier is of a generally frustoconical configuration. Specifically, the inner end section 27 of the barrier is a constant small diameter sized for a sealed fit against the outside of the base 29 of the nozzle (see FIG. 1). The outward end section 30 is of a substantially larger diameter, being sized for engagement with the end 34 of the fill pipe. Extending between the inner and outer end sections, the intermediate section 31 expands radially outward in progressing from the inward end 35 of the inner section to the outer section. Generally, the thickness of the intermediate section of the barrier is constant and, when relaxed as shown in FIG. 1, the inner, outer and intermediate sections 27, 30 and 31, respectively, are each concentrically positioned with respect to a common longitudinal axis 36. Within the outer end section, the elastomeric material is thicker, being of sufficient mass so that when the barrier is compressed axially into engagement with the flange, the intermediate section deforms rather than the outer end section. Specifically, the outer end section includes an annular end surface 37 extending in a radial plane outwardly from a central port 39. In diameter, the size of the end surface is such as to radially overlap the end of the fill pipe in both directions. Formed integrally with the barrier at the radially outermost edge 40 of the end surface is an annular lip 41 which protrudes parallel with the longitudinal axis 36 of the barrier. At the radially inward edge 43 of the end surface, a cylindrical inner wall 44 extends longitudinally toward the inner end section defining the diameter of the central port 39. When inserting the nozzle 19 into the fill pipe, the lip 41 helps guide the central port into alignment with the end opening 16 of the fill pipe.

As mounted on the nozzle 19, the barrier 10 is secured sealingly to the exterior of the nozzle adjacent the base 29 by means of a flexible band 45. The band is tightened around the outside of the inner end section adjacent a small ridge 46 protruding radially outward from the inward end 47 of the inner end section. The length of the barrier along its longitudinal axis 36 is such that the outward end section 30 is spaced a substantial distance from the outlet 23 of the nozzle. Preferably, this distance is such that the relaxed position of the barrier locates the outward end section generally around the outward end 49 of the retainer spring 25, but particularly such that the distance between the outward end of the barrier and the nozzle outlet is such as to allow one to see both the end of the nozzle and the nozzle port 17 in the restricter plate 15 when inserting the nozzle into the fill pipe 13.

As shown in FIG. 1, the length of the inner end section 27 is such that when mounted on the nozzle the longitudinal axis 36 of the barrier deviates from the curvature of the nozzle. Within the inner end section the barrier is concentric with the nozzle but at the outer end section 30, the central port 39 is eccentrically positioned relative to the nozzle. Thus, the nozzle exits the central port 39 below the longitudinal axis 36 of the barrier. Preferably, the eccentric positioning of the barrier on the nozzle is such that the central port and nozzle match the eccentric positioning of the nozzle within the fill pipe opening 16 when supported by the flange 24 in a hands-free position. This relative positioning makes it easier to align the outlet end 23 of the nozzle with the nozzle port 17 in the restricter plate when inserting the nozzle into the fill pipe. As may be seen in FIG. 1, with the nozzle curved downwardly as it exits the central port 39, the top portion of the barrier is cocked rearwardly (or inwardly) relative to the bottom portion. As a result, it is easier to see the end of the nozzle to align it with the nozzle port as the nozzle enters the fill pipe. Moreover, with the lip 41 protruding along the bottom portion of the barrier, it aids in guiding the barrier around the fill pipe flange 24 for the annular end surface 37 to contact the end of the fill pipe.

In use, the inside wall of the barrier 10 effectively defines a dead end chamber 50 (see FIG. 2) closed at the inner end section 27 and opened through the central port 39. When the barrier is pressed against the fill pipe, such as for hands-free dispensing of fuel, the outer end portion of the fill pipe is effectively incorporated into the dead end chamber 50. As previously mentioned, the outward section 30 of the barrier is semi-rigid being substantially thicker than the intermediate section 31 and having a mass such that when a barrier is pressed into contact with the fill pipe flange 24 in the normal hands-free dispensing position, the outer end section remains substantially undeformed while the intermediate section deforms or buckles. As the intermediate section buckles, however, a sufficient force of resistance pushes the annular end surface 37 into contact with the end of the fill pipe. Preferably, the thickness and resiliency of the elastomeric material in the intermediate section 31 is chosen such that this force of resistance is sufficient to maintain the end surface 37 in contact with the flange but is not so great as to cause the retainer spring 25 to disconnect from holding the dispenser in its hands-free dispensing position in the fill pipe. In particular, the resiliency of the material is chosen such that the force of expansion generated by the buckling intermediate section is within the foregoing range regardless of variations in the extent of buckling or compression of the intermediate section due to differences in the depth to which the nozzle may be inserted into the fill pipe. Additionally, advantage is taken of the natural finish irregularities formed in the surface smoothness of the annular surface 37 of the outer end section 30 to avoid forming a vapor-tight seal between the barrier and the end of the fill pipe. Accordingly, the expansion force generated by buckling of the intermediate section is further limited throughout its length to be below that which would cause the finish irregularities in the annular end service to be compressed to an extent which would cause a vapor-tight seal to be made. Preferably, this is true regardless of the difference in pressures which may exist between atmospheric pressure and the pressure existing within the dead-end chamber 50 during normal fuel dispensing conditions. The present arrangement thus has the advantage of avoiding excessive in flow of air to the dead-end chamber 50 to mix with fuel vapors under specialized refueling conditions, for example, when refueling those vehicles where the vent line from the fuel tank exhausts into the fill pipe above the restricter plate 15.

Thus, it is seen from the foregoing that the present invention brings to the art a new and improved mixture barrier for use in a vapor recovery system which helps meet governmentally marketed standards and yet is easier for customers to use.

We claim:

1. In a vapor recovery system for delivering volatile fuel into a vehicle tank through an end opening of a fill pipe having a restricter plate with a nozzle port located therein downstream of an inlet flange, simultaneously recovering fuel vapors displaced from the tank by the inflow of fuel and delivering the vapors through a vapor recovery line to a remote storage vessel, the combination of:

a fuel dispenser with a body;

a nozzle with a base end attached to said body and a free end with a fuel outlet therein, said nozzle being insertable into the fill pipe through said nozzle port with said fuel outlet located downstream of said restricter plate;

a vapor inlet hole formed in said nozzle and located upstream from said outlet and below said restricter plate when dispensing fuel, said hole communicating with said vapor recovery line;

retainer means on said nozzle for catching on said inlet flange of said fill pipe for hands-free fuel dispensing and substantially straight-pull removal; and a tubular mixture barrier formed as a unitary member of a resiliently flexible elastomeric material and having an overall length when mounted on said nozzle enabling an operator's unobstructed simultaneous view of both the end of the nozzle and said restricter plate for relative alignment of said nozzle with said nozzle port immediately preceding insertion of said nozzle therethrough, said barrier further including a first end section sized to fit over said nozzle and into sealing contact therewith adjacent said base end, a second end section having an annular end surface containing finish irregularities and being sized and positioned for contact with said inlet flange when said nozzle is inserted into said end opening of said fill pipe, and an intermediate section integrally formed with and extending between said first and second end sections, said intermediate section when relaxed having an inside surface defining a chamber around said nozzle when mounted thereon, and being resiliently collapsible between said first and second end sections to a variable length along said nozzle dependent upon engagement of said annular end surface with said fill pipe and the depth of insertion of said nozzle into said fill pipe, said elastomeric material being of a flexible resiliency sufficient to provide throughout said variable length of collapse of said intermediate section a force tending to expand said intermediate section, said force being limited in magnitude to enable said retainer means to catch on said flange for hands-free fuel dispensing and essentially a straight-pull removal and to maintain said annular end surface into contact with said fill pipe flange without causing said finish irregularities to be substantially deformed thereby ensuring the existence of a non-sealing contact between said annular end surface and said fill pipe flange regardless of the depth of insertion of said nozzle into said fill pipe and the difference existing, if any, between the pressure in said chamber and atmospheric pressure during normal fuel dispensing conditions.

2. In the combination defined by claim 1, said barrier having a longitudinal axis, said first, second and intermediate sections being concentric to said axis when relaxed, said annular end surface of said second section having an upper portion and a bottom portion oriented respectively above and below said nozzle when said nozzle is generally horizontally disposed, and said nozzle being concentric with said axis at said base end and in an eccentric position with respect to said axis adjacent said free end thereof, said eccentric position substantially matching the natural eccentric position of said nozzle relative to said end opening of said fill pipe when resting on said flange during hands-free dispensing of fuel.

3. The combination as defined by claim 2 wherein said second end section includes a cylindrical inner wall extending longitudinally inward from said annular end surface toward said first end section and defining a central port through said backing ring with said central port being sized to register in general alignment with said end opening, and a lip integrally formed with said end surface outside of said central port and extending in a generally longitudinal direction forward from said surface for said lip to guide along the outside of said fill pipe and thereby aid in aligning said annular end surface into abutting engagement with said flange and said port with said end opening.

4. In the combination as defined by claim 3, said resiliently flexible elastomeric material having a Shore A durometer hardness in the range of 80 to 90.

5. In the combination as defined by claim 4 wherein said chamber is a dead-end chamber.

6. A mixture barrier sized for mounting around a nozzle of a fuel dispenser to enclose an end opening of a fuel tank fill pipe from the atmosphere to aid in recovering fuel vapors displaced from said fuel tank when dispensing fuel, said barrier being a unitary generally tubular member formed of a resiliently flexible elastomeric material and having an overall length when mounted on said nozzle enabling an unobstructed simultaneous view of both the end of the nozzle and a restricter plate in said fill pipe for relative alignment of said nozzle with a port in said plate immediately preceding insertion of said nozzle through said port, said barrier further including a first end section sized to fit over said nozzle and into sealing contact therewith, a second end section having an annular end surface containing finish irregularities and being sized and positioned for contact with said fill pipe when said nozzle is inserted through said end opening and into said fill pipe, and an intermediate section integrally formed with and extending between said first and second end sections, said intermediate section when relaxed having an inside surface defining a chamber around said nozzle when mounted thereon, and being resiliently collapsible between said first and second end sections to a variable length along said nozzle dependent upon engagement of said annular end surface with said fill pipe and the depth of insertion of said nozzle into said fill pipe, said elastomeric material being of a flexible resiliency sufficient to provide throughout said variable length of collapse of said intermediate section a force tending to expand said intermediate section, said force being limited in magnitude to maintain said annular end surface into contact with said fill pipe and to do so without causing said finish irregularities to be substantially deformed thereby ensuring the existence of a non-sealing contact between said annular end surface and said fill pipe regardless of the depth of insertion of said nozzle into said fill pipe and the difference, if any, between the pressure existing in said chamber and atmospheric pressure during normal fuel dispensing conditions.

7. A mixture barrier as defined by claim 6 for use on a fuel dispenser having a retainer means mounted around said nozzle to catch on an end flange of said fill pipe for hands-free fuel dispensing by said operator and substantially straight-pull removal when completed, said force tending to expand said intermediate section further being limited in magnitude such as to enable said retainer means to catch on said flange for said hands-free fuel dispensing and essentially a straight-pull removal.

8. A mixture barrier as defined by claim 6 having a straight longitudinal axis, and said first, second and intermediate sections of said barrier being substantially concentric to said axis when said intermediate section is relaxed in position, and when mounted on said nozzle said barrier further being positioned with said first end section concentric with respect to said nozzle and said second end section in an eccentric position with respect to said nozzle, said eccentric position substantially matching the natural eccentric position of said nozzle relative to said end opening when resting on said flange during hands-free dispensing of fuel.

9. A mixture barrier as defined by claim 8 wherein said chamber is a dead-end chamber.

10. A mixture barrier as defined by claim 8 wherein said second end section includes a cylindrical inner wall extending longitudinally inward from said annular end surface toward said first end section and defining a central port therethrough with said central port being sized to register in general alignment with said end opening, and a lip integrally formed with said end surface outside of said central port and extending in a generally longitudinal direction forward from said surface for said lip to guide along the outside of said fill pipe and thereby aid in aligning said annular end surface into abutting engagement with said flange and said port with said fill pipe opening.

11. In a vapor recovery system for delivering volatile fuel into a vehicle tank through an end opening of a fill pipe having a restricter plate with a nozzle port located therein downstream of an inlet flange while simultaneously recovering the fuel vapors displaced from the tank by the inflow of fuel and delivering the vapors through a vapor recovery line to a remote storage vessel, the combination of:

a fuel dispenser with a body;

a nozzle with a base end attached to said body and a free end with a fuel outlet therein, said nozzle being insertable into the fill pipe through said nozzle port with said fuel outlet located downstream of said restricter plate;

a vapor inlet hole formed in said nozzle and located upstream from said outlet and below said restricter plate when dispensing fuel, said hole communicating with said vapor recovery line;

retainer means on said nozzle for catching on said inlet flange of said fill pipe for hands-free fuel dispensing and substantially straight-pull removal;

a tubular mixture barrier formed as a unitary member of a resiliently flexible elastomeric material and having an overall length when mounted on said nozzle enabling an operator's unobstructed simultaneous view of both the end of the nozzle and said restricter plate for relative alignment of said nozzle with said nozzle port immediately preceding insertion of said nozzle therethrough;

said barrier further including a first end section sized to fit over said nozzle and into sealing contact therewith adjacent said base end, a second end section having an annular end surface and positioned for contact with said inlet flange when said nozzle is inserted into said end opening of said fill pipe, and an intermediate section integrally formed with and extending between said first and second end sections, said intermediate section when relaxed having an inside surface defining a chamber around said nozzle when mounted thereon and being resiliently collapsible between said first and second end sections to a variable length along said nozzle dependent upon engagement of said annular end surface with said fill pipe inlet flange and the depth of insertion of said nozzle into said fill pipe;

said elastomeric material being of a flexible resiliency sufficient to provide throughout said variable length of collapse of said intermediate section a force tending to expand said intermediate section;

said force being limited in magnitude to enable said retainer means to catch on said flange for hands-free fuel dispensing and essentially a straight-pull removal and to maintain said annular end surface into contact with said fill pipe inlet flange without causing a sealing contact between said annular end surface and said fill pipe inlet flange regardless of the depth of insertion of said nozzle into said fill pipe and the difference existing, if any, between the pressure in said chamber and atmospheric pressure during normal fuel dispensing conditions;

said barrier having a longitudinal axis with said first, second and intermediate sections being concentric to said axis when relaxed;

said annular end surface of said second section having an upper portion and a bottom portion oriented respectively above and below said nozzle when said nozzle is generally horizontally disposed;

said nozzle being concentric with said axis at said base end and in an eccentric position with respect to said axis adjacent said free end thereof, said eccentric position substantially matching the natural eccentric position of said nozzle relative to said end opening of said fill pipe when resting on said flange during hands-free dispensing of fuel; and said second end section having a cylindrical inner wall extending longitudinally inward from said annular end surface toward said first end section and defining a central port through said backing ring with said central port being sized to register in general alignment with said end opening, and a lip integrally formed with said end surface outside of said central port and extending in a generally longitudinal direction forward from said surface for said lip to guide along the outside of said fill pipe and thereby aid in aligning said annular end surface into abutting engagement with said flange and said port with said end opening.

12. A mixture barrier sized for mounting around a nozzle of a fuel dispenser to enclose an end opening of a fuel tank fill pipe from the atmosphere to aid in recovering fuel vapors displaced from said fuel tank when dispensing fuel, said barrier being a unitary, generally tubular member formed of an elastomeric material and having an overall length when mounted on said nozzle enabling an unobstructed simultaneous view of both the end of the nozzle and a restricter plate in said fill pipe for relative alignment of said nozzle with a port in said restricter plate immediately preceding insertion of said nozzle through said port, said barrier further comprising:

a first end section sized to fit over said nozzle and into sealing contact therewith, a second end section having an annular end surface sized and positioned for contact with said fill pipe when said nozzle is inserted through said end opening and into said fill pipe, and an intermediate section intricately formed with and extending between said first and second end sections;

said intermediate section when relaxed having an inside surface defining a chamber around said nozzle when mounted thereon and being resiliently collapsible between said first and second end sections to a variable length along said nozzle dependent upon engagement of said annular end surface with said fill pipe and the depth of insertion of said nozzle into said fill pipe;

said elastomeric material having a flexible resiliency sufficient to provide throughout said variable length of collapse of said intermediate section a force tending to expand said intermediate section;

said force being limited in magnitude to maintain said annular end surface in contact with said fill pipe and at the same time insuring the existence of a non-sealing contact between said annular end surface and said fill pipe regardless of the depth of insertion of said nozzle into said fill pipe and the difference, if any, between the pressure existing in said chamber and atmosphere pressure during normal fuel dispensing conditions;

said mixture barrier having a longitudinal axis with said first, second and intermediate sections of said barrier being substantially concentric to said axis when said intermediate section is in its relaxed position, and when mounted on said nozzle said barrier further positioned with said first end section concentric with respect to said nozzle and said second end section in an eccentric position with respect to the said nozzle, said eccentric position substantially matching the natural eccentric position of said nozzle relative to said end opening when resting on said flange during hands free dispensing of fuel;

said second end section having a cylindrical inner wall extending longitudinally inward from said annular end surface toward said first end section and defining a central port therethrough with said central port being sized to register in general alignment with said end opening; and a lip intricately formed with said end surface outside of said central port and extending in a generally longitudinal direction forward from said surface for said lip to guide along the outside of said fill pipe and thereby aid in aligning said annular end surface into an abutting engagement said flange and said port with said fill pipe opening.

* * * * *